US005554014A

United States Patent [19]

Becker

[11] Patent Number: 5,554,014

[45] Date of Patent: Sep. 10, 1996

[54] DIAPHRAGM PUMP WITH AT LEAST TWO DIAPHRAGMS

[75] Inventor: Erich Becker, Bad Krozingen, Germany

[73] Assignee: KNF Neuberger GmbH, Freiburg Munzingen, Germany

[21] Appl. No.: 292,600

[22] Filed: Aug. 18, 1994

[30] Foreign Application Priority Data

Aug. 25, 1993 [DE] Germany ..... 43 28 559.7

[51] Int. Cl.[6] ..... F04B 43/02

[52] U.S. Cl. ..... 417/413.1; 92/99

[58] Field of Search ..... 417/413.1; 92/48, 92/99

[56] References Cited

U.S. PATENT DOCUMENTS

| | | | |
|---|---|---|---|
| 3,620,652 | 11/1971 | Jaspers et al. | 417/439 |
| 3,789,675 | 2/1974 | Kocher | 74/18.2 |
| 3,809,506 | 5/1974 | Malcosky | 417/439 |
| 4,049,366 | 9/1977 | Becker | 417/569 |
| 4,086,036 | 4/1978 | Hagen et al. | 417/413.1 |
| 4,993,925 | 2/1991 | Becker et al. | 417/413.1 |
| 5,145,336 | 9/1992 | Becker et al. | 417/413.1 |

FOREIGN PATENT DOCUMENTS

| | | | |
|---|---|---|---|
| 2146016 | 3/1973 | Germany | 417/413.1 |
| 63-189675 | 8/1988 | Japan | 417/413.1 |
| 1312125 | 4/1973 | United Kingdom . | |
| 1313393 | 4/1973 | United Kingdom . | |

*Primary Examiner*—Richard E. Gluck

*Attorney, Agent, or Firm*—Panitch, Schwarze, Jacobs & Nadel, P.C.

[57] ABSTRACT

A diaphragm pump (1) with a working diaphragm (16) is provided with an additional diaphragm (26) arranged at a distance (a) from the working diaphragm (16), between the working diaphragm and eccentric drive (7). The diaphragm pump (1) provided with an additional diaphragm may alternatively have a swing connecting-rod with U packing ring instead of the working diaphragm (16). The additional diaphragm, together with a lateral confinement formed by an intermediate casing (4) of the pump case (2), composes an essentially closed diaphragm interspace. A deformable annular zone (30) of the additional diaphragm (26) has a channel-like convexity (31) which, in the undeformed condition of the diaphragm, points in the direction of the eccentric drive (7). For this purpose, the elastically deformable annular zone (30) of the additional diaphragm (26) has a radial expanse wider than the deformable annular zone (24) of the working diaphragm (16). When, for instance, the diaphragm/U packing ring interspace (29, 129) is evacuated, contamination of the pumped medium by the contents of the diaphragm/U packing ring interspace (29, 129) is largely prevented in case of damage to the working diaphragm (16)/U packing ring (143).

12 Claims, 4 Drawing Sheets

DIAPHRAGM PUMP WITH AT LEAST TWO DIAPHRAGMS

FIELD OF THE INVENTION

The invention relates to diaphragm pumps with a working diaphragm as well as to swing connecting-rod pumps with a U packing ring. More particularly, the invention is directed to such pumps which have an additional diaphragm with a deformable annular zone which forms an interspace between the additional diaphragm and the working diaphragm or U packing ring.

BACKGROUND OF THE INVENTION

Diaphragm pumps with two diaphragms are already known from U.S. Pat. No. 4,049,366 (which is equivalent to German Auslegeschrift No. 25 02 556), wherein one working diaphragm closes the pump chamber, and on the side thereof opposite this pump chamber there is a further chamber closed by an additional diaphragm. However, not only the working diaphragm but preferably both diaphragms in that reference are approximately flat and level in the undeformed condition. The chamber situated between the working diaphragm and additional diaphragm takes the form of a damping space in which prevails a pressure reduced in comparison to the admission pressure of the pump, in such a way as to constantly draw the working diaphragm into a deflected position directed away from the pump chamber. Through the lower pressure acting on the side facing the crank-driving mechanism of the working diaphragm, one can ensure that the working diaphragm is constantly drawn into a deflected position directed away from the pump chamber. By this means the tendency the working diaphragm has to oscillate can be reduced to a considerable extent, thereby increasing the service life of the working diaphragm.

However, such diaphragm pumps, which have proved to be advantageous and successful in many respects, also have disadvantages: when working with very valuable gases, for instance costly inert gases, as the pumped medium works and the working diaphragm becomes loose, the valuable pumped gases quite often become contaminated because of an after-flow which can then occur from the damping space (i.e., the interspace between the diaphragms).

Contamination of the pumped gas is also particularly disadvantageous in swing connecting-rod pumps, because U packing rings or face seals are used there which have a leakage flow during operation and therefore do not permit the pump chamber to be fully sealed with respect to the crankcase zone. In principle, the interspace between the working diaphragm and the additional diaphragm (diaphragm pump), hereinafter referred to as diaphragm interspace, or between the U packing ring and the additional diaphragm (swing connecting-rod pump), hereinafter referred to as U packing ring interspace, could be substantially evacuated and the danger of contamination of the valuable pumped media could thereby be greatly reduced. However, this would involve the drawback that the freely movable, annular zone of the additional diaphragm deflects in the direction of the working diaphragm/U packing ring, and might even be exposed to alternating flexural load. In order to avoid unnecessary wear, measures would then also have to be taken to ensure that unwanted contact is not established between the additional diaphragm and working diaphragm (diaphragm pump) or between the additional diaphragm and the upper part of the connecting rod (swing connecting-rod pump).

SUMMARY OF THE INVENTION

The object underlying the invention is therefore in particular to provide a pump, particularly with swing connecting-rod drive, wherein the space between pump chamber and additional diaphragm can be substantially evacuated. This applies particularly to diaphragm pumps in which there are at least two diaphragms, one of which in the form of a working diaphragm closes the pump chamber. In the undeformed condition, the deformable annular zone of the working diaphragm is preferably configured to be essentially generally flat and level. This diaphragm pump is provided with at least one additional diaphragm which has a deformable annular zone and is arranged between the working diaphragm and crank drive thereof, wherein a laterally defined, at least essentially closed diaphragm interspace is formed between the two diaphragms.

In accordance with the object of the invention, the diaphragm interspace can be largely evacuated without this leading to excessive movements of the additional diaphragm located adjacent to the diaphragm interspace. At the same time, as is often the case in diaphragm pumps having two diaphragms, the additional diaphragm is to be subject to less loading during pump operation. Therefore, in the event of breakdown, the working diaphragm is from experience the first to suffer damage at a time when the additional diaphragm is still undamaged and is, for instance, capable of preventing any contamination of valuable pumped medium.

The object underlying the invention further relates to a swing connecting-rod pump having at least one U packing ring which seals the pump chamber against the bearing surface of a pump cylinder and including an additional diaphragm with a deformable annular zone, wherein an at least essentially closed space, laterally defined by the pump cylinder, is formed between U packing ring and the diaphragm.

The object is accomplished according to the invention particularly by providing the deformable annular zone of the additional diaphragm with a channel-like convexity which, in the undeformed condition, points toward the eccentric drive of the pump. In the case of a diaphragm pump with working diaphragm, the radial expanse of the elastically deformable annular zone of the additional diaphragm is greater (wider) than that of the deformable annular zone of the working diaphragm.

The swing connecting-rod pump according to the invention has the following particular advantages: As a rule, the U packing ring bears higher operating pressures than the additional diaphragm, but is not completely tight; neither is it wear-free owing to the friction against the cylinder wall. The period of average life of the additional diaphragm can be influenced by appropriate selection of the radial expanse (width) of the additional diaphragm in relation to the longitudinal central axis of the connecting rod of the pump. A larger radial width leads to lower tensile forces in the diaphragm and therefore results in an increased service life. Through appropriate selection of the radial width, the service life of the additional diaphragm can therefore be set in such a way that from experience the additional diaphragm is still intact upon failure of the U packing ring. Throughout its area, but particularly in the deformable annular zone, the additional diaphragm is at a sufficient distance from the holder of the U packing ring. Unwanted contact of the additional diaphragm with the U packing ring is therefore avoided, even in a compact design.

The advantages of the diaphragm pump according to the invention are particularly: The working diaphragm brings about a complete sealing of the pump chamber. The deformable annular zone of the additional diaphragm, viewed in the radial direction, is appreciably wider than the corresponding, deformable annular zone of the working diaphragm. Accordingly, in normal pump operation, the loading of the additional diaphragm is appreciably lower than that of the working diaphragm. In the central areas of the deformable annular zones the distance between working diaphragm and additional diaphragm is relatively large, as also is the volume of the diaphragm interspace. By this means, unwanted contacts between the working diaphragm and additional diaphragm are practically prevented, even if a compact design with diaphragms situated close together is selected.

Further developments of the invention include positioning the channel-like convexity at least approximately centered on the longitudinal central axis of the additional diaphragm, and preferably as a continuous, circular ring shape, which are advantageous in allowing the additional diaphragm to be loaded symmetrically and substantially uniformly and, furthermore, allowing it to be manufactured relatively simply. Also, in the event of damage to the working diaphragm, if the medium to be delivered is to be substantially protected against contamination related to such damage, then the diaphragm/U packing ring interspace will be substantially evacuated.

It is suitable for the additional diaphragm to have a holder in order that, for instance, in the event of such a reduction of pressure or even extensive evacuation in the diaphragm/U packing ring interspace, the channel-like configuration of the convexity of the additional diaphragm does not lead to its convexity "flipping" in the direction of the working diaphragm (diaphragm pump)/U packing ring holder (swing connecting-rod pump), but its channel-like convexity is maintained in the direction of the crankcase. These measures also help to avoid unnecessary diaphragm movements in the region of the channel-like convexity.

The relative structural design of the holder can be achieved, for example, with the aid of holding-down ribs provided on the additional diaphragm on the side facing the eccentric drive, preferably radially oriented, and connected to the conventional rod arm, suitably by means of a hollow shank belonging to the additional diaphragm and adapted to the connecting-rod arm. The holding-down ribs may be provided so as to be slightly flexible in a direction towards the axis of the connecting-rod arm. This makes it possible to minimize or avoid peak stresses of the material in the additional diaphragm together with its holder, as are encountered during the usual connecting-rod movement.

Providing the additional diaphragm with a stabilizing ring, preferably of continuous, circular ring shape, up to which the radially outer end areas of the holding-down ribs may extend, assists largely in maintaining the initial, cross-sectional shape of the additional diaphragm during operation. This also applies if the holding-down ribs connect the hollow shank of the additional diaphragm to the bottom area of the channel-like convexity, the effect of which may be enhanced by a stabilizing ring at the bottom of the convexity. Stabilizing ribs in the area between the stabilizing ring and the side edge of the additional diaphragm strengthen the radially outer, peripheral area of the convexity. These measures also permit the avoidance of an excessive accumulation of material, accompanied by otherwise comparable conditions. Stabilizing ribs arranged radially, and some preferably aligned with the holding-down ribs contribute towards a symmetrical configuration of the additional diaphragm. On the one hand this reduces the danger of peak stresses and on the other hand simplifies the manufacture of the additional diaphragm.

Providing a radially projecting retaining bead near the upper, free zone of the connecting-rod arm and there adapting the inner contour of the hollow shank of the additional diaphragm to the outer contour of the connecting-rod arm create a particularly simple, effective connection between the additional diaphragm and the middle zone of the free end of the connecting rod. An evacuation canal in the intermediate casing enables the creation of a vacuum in a simple way in the diaphragm interspace or, for instance, allows the introduction of a gas which is neutral with respect to the pumped medium, e.g., with low pressure.

BRIEF DESCRIPTION OF THE DRAWINGS

The foregoing summary, as well as the following detailed description of preferred embodiments of the invention, will be better understood when read in conjunction with the appended drawings which show further features and advantages of the invention. For the purpose of illustrating the invention, there are shown in the drawings embodiments which are presently preferred. It should be understood, however, that the invention is not limited to the precise arrangements and instrumentalities shown. The individual features may be realized singly or severally in embodiments of the invention. The drawings show in different scales and partly accentuated diagrammatic form.

DETAILED DESCRIPTION OF PREFERRED EMBODIMENTS

Figure 1:
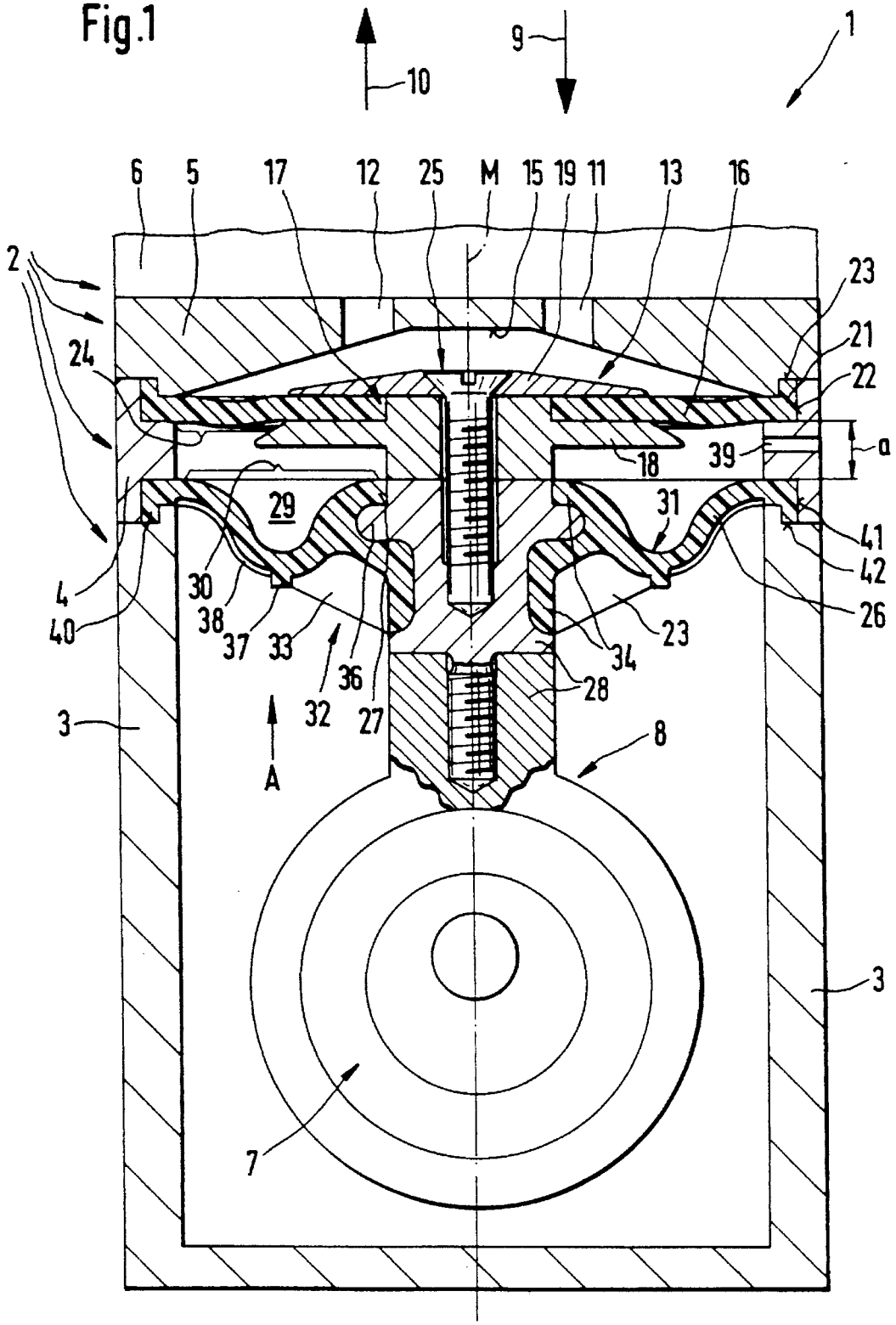
FIG. 1 is a side view, essentially in section, of a diaphragm pump according to the invention.

A diaphragm pump 1 (FIGS. 1–3), hereinafter referred to in short as "pump 1" has a case 2. This case is composed essentially of a crankcase 3, an intermediate casing 4, an upper casing 5, as well as a casing top 6 shown only in part in FIG. 1. Located in the crankcase 3 is the eccentric drive 7 for a swing piston 8. Provided in the usual way in the casing top 6, but not shown, are valves and connecting sleeves for the inlet and outlet conduits of the pump 1. Arrows 9 and 10 indicate the flow direction of the pumped medium respectively to and from the pump 1. Provided for this purpose in the upper casing 5 are one inlet port 11 and one outlet port 12 each, leading from the casing top 6 to the pump chamber 13.

Figure 2:
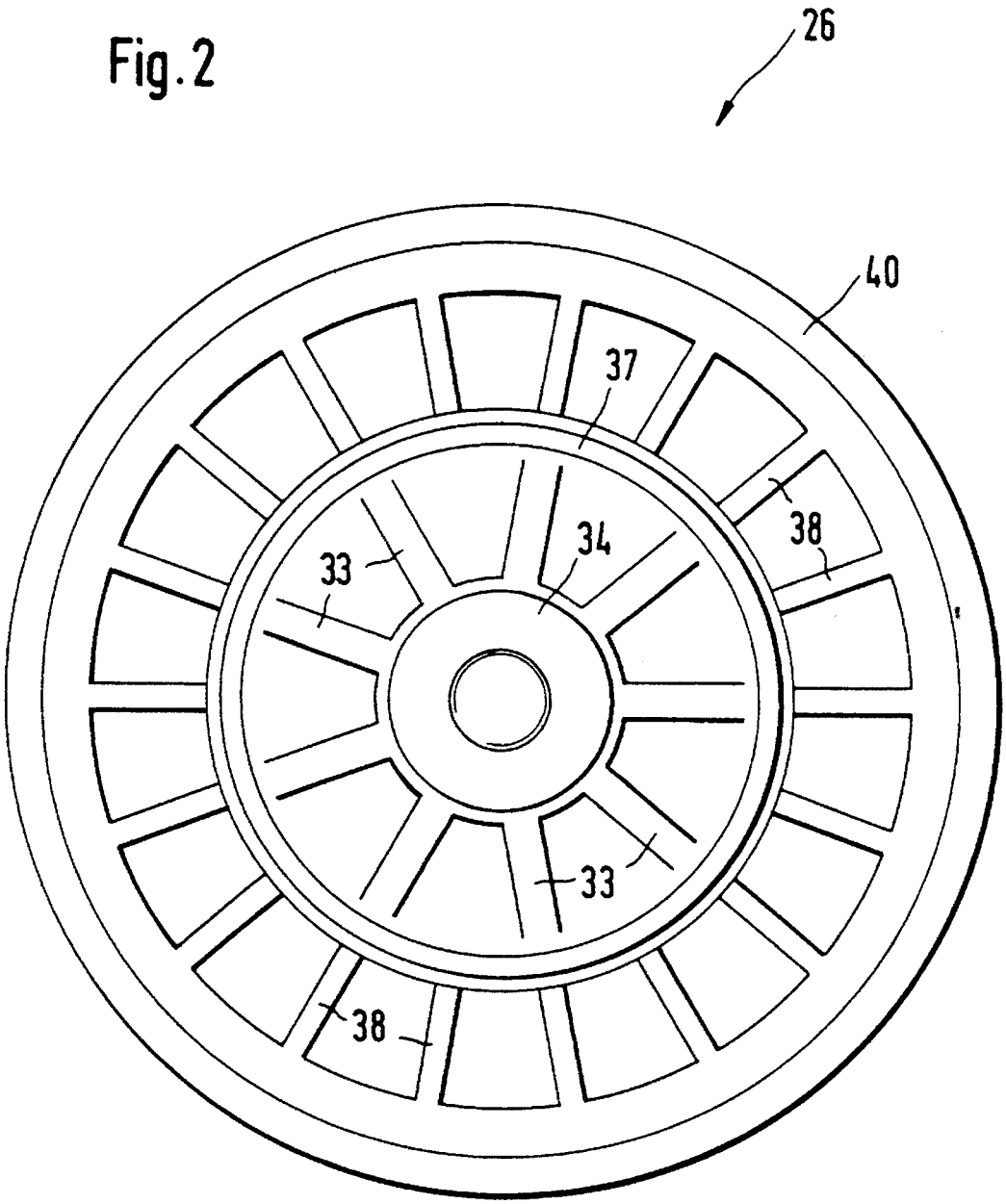
FIG. 2 is a view of the face of an additional diaphragm, taken from direction A in FIG. 1.

The pump chamber 13 is accommodated in the upper casing 5 as a recess essentially, for example, trapezoidal in cross-section. In FIG. 1, the pump chamber 13 is defined upwardly and laterally by the upper end 15 of the pump chamber, while it is closed on the bottom with the aid of a working diaphragm 16. In the undeformed condition shown in FIG. 1, the working diaphragm is essentially generally flat and level. The working diaphragm is sealingly clamped at its inner edge 17 by the connecting-rod head 18, widened there in a generally mushroom shape, and a clamping plate 19 cooperating with this connecting-rod head. The working diaphragm 16 has, in a known way, an enlargement 21 running around its outer edge in a ring shape. With this enlargement, the working diaphragm engages with corresponding, complementary recesses 22 and 23 in the intermediate casing 4 and upper casing 5, respectively, and is sealingly clamped there in a known manner.

The working diaphragm 16 has a deformable annular zone 24 in the region between where the working diaphragm 16 is centrally clamped between connecting-rod head 18 and clamping plate 19, on the one hand, and the above-described clamping zone composed the recesses 22, 23 in the intermediate and upper casing 4, 5 at the outer edge of the working diaphragm 16. This annular zone has a somewhat larger radial expanse than accords with the clearance between the two above-mentioned fixing points for the working diaphragm 16. In FIG. 1, this can also be seen from the slight bulge of the deformable annular zone 24. In a known way, the abovedescribed dimensioning of the working diaphragm 16 serves to allow it to easily follow the movement of stroke of the upper area 25 of the swing piston 8. In particular, the working diaphragm is not unnecessarily subjected to tensile stress through the movement of stroke, but on the other hand provides the upper area 25 of the swing piston 8 with some lateral guidance.

A further diaphragm, herein referred to as "additional diaphragm 26" is provided at a distance a from the working diaphragm 16 in the direction of the crankcase 3. The additional diaphragm 26 has at its radially outer edge an annular enlargement 40, similar to that already described in connection with the working diaphragm 16. In the region of this enlargement 40 the additional diaphragm 26 is also sealingly clamped between the intermediate casing 4 and the crankcase 3 having corresponding recesses 41 and 42 therein. A central zone 27 of the additional diaphragm 26 reaches to the connecting-rod arm 28 of the swing piston 8 and is likewise tightly connected thereto. The diaphragm interspace 29 resulting between the two diaphragms 16 and 26 is defined radially at the sides by the intermediate casing 4 and thus, as a rule, is essentially sealed off.

A feature of the invention is that the additional diaphragm 26 likewise has an elastically deformable annular zone 30 and that this annular zone, viewed in a radial direction, has a larger expanse (width) than the radially deformable annular zone 24 of the working diaphragm 16. A further feature of the invention is that the deformable annular zone 30 of the additional diaphragm has a channel-like convexity 31 which, in the undeformed condition of the diaphragm, points in the direction of the eccentric drive 7, as can be seen particularly well in FIGS. 1 and 3. As is apparent there, the additional diaphragm 26 is subjected to little stress, particularly to less tensile stress, as the swing piston 8 performs the stroke. The channel-like convexity 31 enables the additional diaphragm 26 to follow the movement of stroke of the swing piston 8 without any great flexing work and without incurring any significant stresses.

In the present embodiment, the channel-like convexity 31 is centered on the central axis M of the additional diaphragm 26 and, viewed from above, is of continuous, circular ring shape.

It is especially advantageous if the interspace 29 between the working diaphragm 16 and the additional diaphragm 26 is evacuated. As already mentioned, when delivering pumped media which are to be kept pure, e.g., costly inert gases, one can thereby prevent any serious contamination of the pumped medium from occurring upon damage to the working diaphragm 16. At least the extent of contamination can be considerably reduced. When working with special pumped media, the diaphragm interspace can also be filled with such a medium at reduced pressure as does not cause any significant damage if mixed with the pumped medium proper. If the pressure in the diaphragm interspace 29 is, for example, appreciably lower than in the working circuit in communication with the pump chamber 13, then at most a certain amount of the pumped medium will flow into the diaphragm interspace 29. However, the main delivery circuit in communication with the pump 1 will not become contaminated or will be contaminated only insignificantly. Conditions can be set at which the quantitative loss of the pumped medium saved by the pump is kept within correspondingly low limits.

Figure 3:
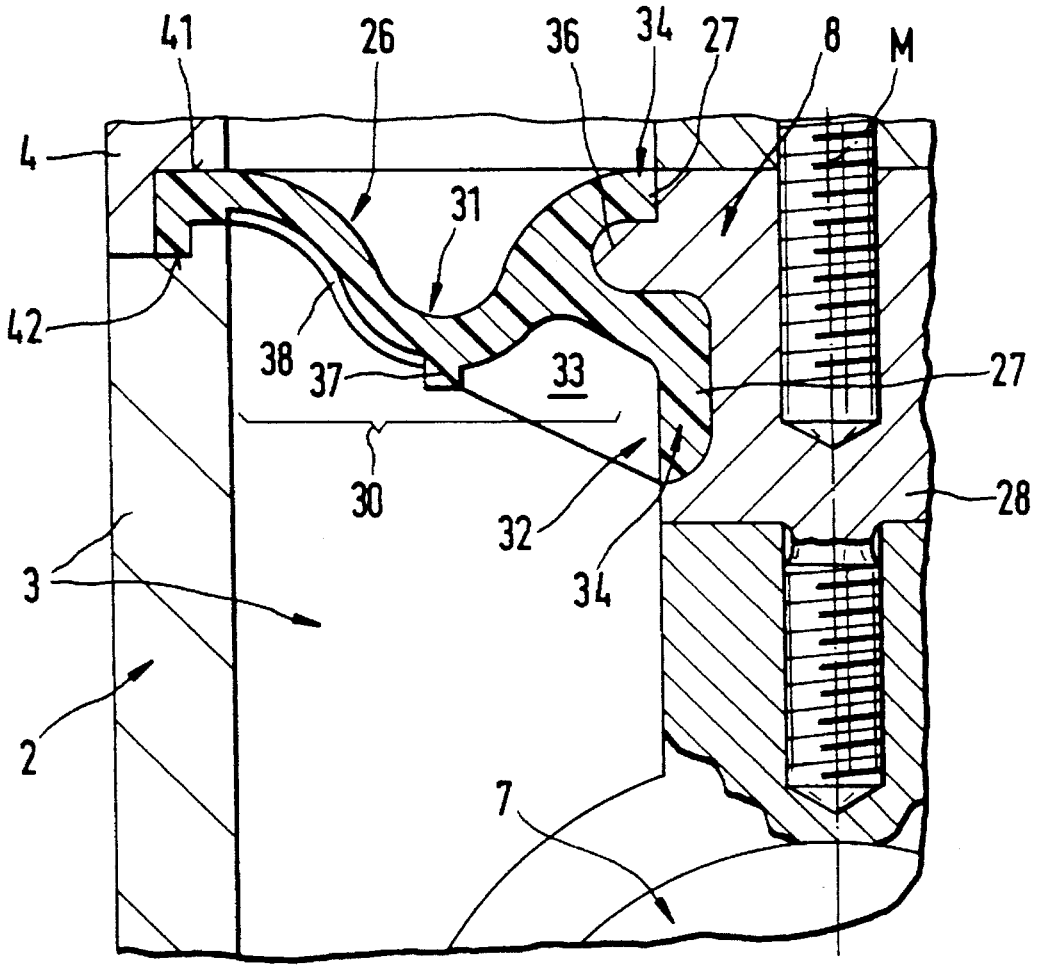
FIG. 3 is a partial cross-section of an additional diaphragm and its surroundings, as an enlarged detail of FIG. 1.

If the elastically deformable annular zone 30 of the additional diaphragm 26 is thus provided with a channel-like convexity pointing in the direction of the eccentric drive 7, there is in principle the danger that, given appropriate reduced pressure in the diaphragm interspace 29, this convexity 31 will assume an unwanted position differing considerably from that shown in FIGS. 1 and 3. That is, the channel-like convexity might "flip" in the direction of the working diaphragm 16. There would then be the danger of unwanted friction, premature wear, etc. Since, however, the object of the invention contemplates that the additional diaphragm 26 is, as a rule, to have a longer service life than the working diaphragm 16, so as to satisfy a respective safety function, an important development of the invention includes the channel-like convexity 31 of the additional diaphragm 26 having a holder 32 maintaining the direction of its convexity toward the crankcase 3. This dependably prevents unwanted reversal of the channel-like convexity 31 in the direction of the working diaphragm 16.

An embodiment, by means of which the above-described direction of convexity of the additional diaphragm 16 can be dependably maintained in the direction of crankcase 3, comprises preferably radially oriented, holding-down ribs 33 being provided at the additional diaphragm 26 and being indirectly connected to the connecting-rod arm 28 of the eccentric drive 7. In accordance with a further development of the invention, for the same purpose, the additional diaphragm 26 has incorporated therein a hollow shank 34 which embraces the connecting-rod arm 28 in a sleeve-like fashion and is fixed thereon, preferably form-lockingly, in both radial and axial directions. Both the hollow shank 34 and/or the holding-down ribs 33 may be somewhat elastic so as on the one hand to avoid any substantial stresses during movement of the swing piston 8, and on the other hand for the position of the channel-like convexity 31 to be dependably maintained in the direction of the crankcase 3.

A radially projecting retaining bead 36 is provided near the free, upper region 25 of the connecting-rod arm 8, and the inner contour of the hollow shank 34 of the additional diaphragm 26 is there adapted to the outer contour of the connecting-rod arm 28; i.e. the retaining bead 36 form-lockingly fixes the hollow shank 34 of the additional diaphragm 26. However, it is also possible for the additional diaphragm 26 and hollow shank 34 thereof to be clampingly gripped at the connecting-rod arm 28. In this way several advantages are attained by simple means: The central position of the additional diaphragm 26 is sufficiently fixed in relation to the connecting-rod arm 28, but a certain flexibility is preserved to avoid peak stresses in the additional diaphragm 26. In addition, it is possible for the additional diaphragm to be simply replaced if need be. For, as is generally known, both the working diaphragm 16 and the additional diaphragm 26 are, by design, parts of the pump 1 which are subject to wear and have to be replaced from time to time.

The additional diaphragm 26, its holder 32, the appertaining holding-down ribs 33, as well as the stabilizing ribs 38, yet to be described, and a stabilizing ring 37 are suitably integrally formed. This improves the solidity and fatigue strength of the additional diaphragm 26 as well as the simplicity with which it can be manufactured and fitted.

As is apparent from the drawings, the additional diaphragm 26 has in that area of the channel-like convexity 31 which faces the eccentric drive 7 a stabilizing ring 37 preferably of continuous, circular shape. The radially outer end areas of the holding-down ribs 33 extend up to the stabilizing ring 37. In particular, the rotationally symmetrical effect of the holding-down ribs 33 is thereby increased. The uniformity of the loading of the additional diaphragm 26 can also be promoted by this means.

The holding-down ribs 33 connect the hollow shank 34 of the additional diaphragm 26 to the bottom area of the channel-like convexity 31. The holding-down ribs 33 are preferably directly connected to the stabilizing ring 37. (FIG. 3).

It is apparent particularly from FIG. 3 that the additional diaphragm 26 has radially arranged stabilizing ribs 38 on its side facing the eccentric drive 7, in the area between the side edge of the additional diaphragm and the region of the stabilizing ring 37 of the channel-like convexity 31. Preferably, at least some of the stabilizing ribs 38 are aligned with holding-down ribs 33, as is apparent from FIG. 2.

An evacuating passage 39 can be seen well in FIG. 1, with the aid of which it is possible to bring the diaphragm interspace 29 to a lower pressure.

Figure 4:
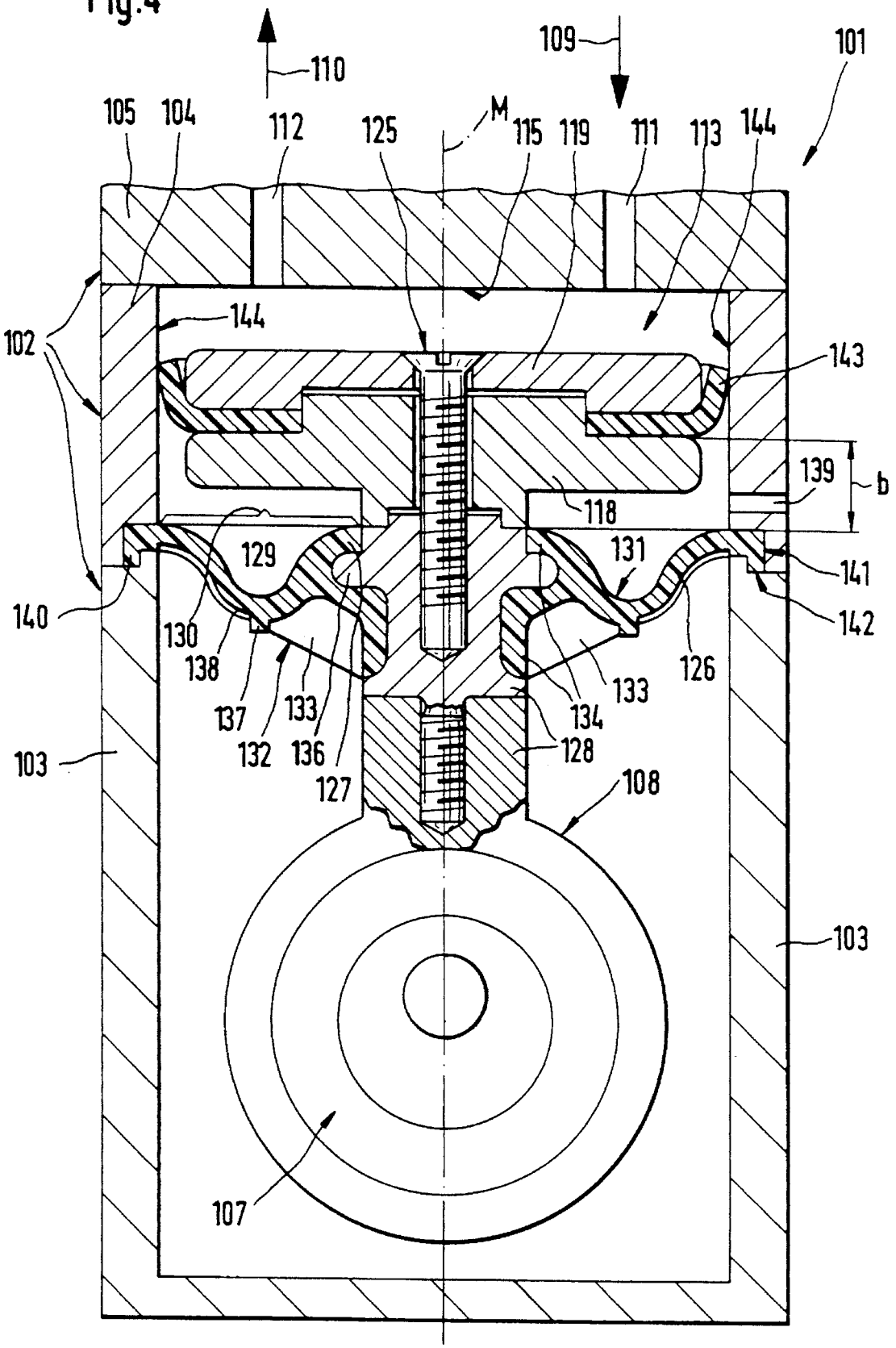
FIG. 4 is an essentially sectional side view of a swing connecting-rod pump with U packing ring according to the invention, comparable to the side view of FIG. 1.

A modified embodiment of the above-described pump 1 will be described in conjunction with FIG. 4, showing a diaphragm pump 101 with swing connecting-rod 108. The latter has a U packing ring 143 and a case 102 which, similarly to the pump 1 of FIG. 1, is essentially composed of a crankcase 103, an intermediate casing 104 and an upper casing 105. Located in the crankcase 103 is the eccentric drive 107 for a swing piston 108. The valves and connecting sleeves present in the usual way, for the inlet and outlet conduits of the pump 101 are not shown in FIG. 4. Arrows 109 and 110 indicate the flow direction of the pumped medium, respectively into and out of the pump 101. Provided for this purpose in the upper casing 105 are one inlet port 111 and one outlet port 112 each, leading to the pump chamber 113. The pump chamber 113 is essentially generally rectangular in cross section and is defined by the upper end 115 of the pump chamber, the bearing surface 144 for the U packing ring 143, as well as by the U packing ring 143 itself, and a clamping plate 119.

The U packing ring 143 takes the form of a cup-shaped ring which in its inner annular area runs essentially approximately flat and level and in its outer zone has the shape of a hollow cone. The U packing ring 143 is sealingly clamped between the clamping plate 119 and the connecting-rod head 118, which have approximately the same outer diameters. The outer edges of connecting-rod head 118 and clamping plate 119 are rounded to avoid damage to the U packing ring 143. That outer edge of the clamping plate 119 which is averted from the pump chamber 113 is also adapted in shape to the transitional area between the level and conical areas of the U packing ring 143. By this means the stresses in the especially loaded transitional area of the U packing ring 143 are reduced.

The U packing ring 143 is clamped between clamping plate 119 and connecting-rod head 118 in such a way that the contact surface of the U packing ring 143 with the bearing surface 144 is located between the clamping plane of the U packing ring 143 and the upper end 115 of the pump chamber. In order that the U packing ring 143 sits securely, the outside diameter is selected to be somewhat larger than the diameter of the cylindrical bearing surface 144.

An additional diaphragm 126 is situated at distance b from the U packing ring and is identical in design to the additional diaphragm 26 of the diaphragm pump 1. That stated with respect to the diaphragm pump 1 therefore applies analogously here, while here the diaphragm spacing a corresponds to the height of the U packing ring interspace b. The reference numerals accorded to pump 101 correspond in the series of one hundred to those accorded to pump 1.

The above-described diaphragm pumps are suited particularly for delivering gaseous or vaporous media.

All the individual features described above and/or recited in the claims may be of material importance to the invention in their own right or in combined form. It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A diaphragm pump (1) comprising a pump case (2) having a pump chamber (13) at one end thereof including an inlet port (11) and an outlet port (12) adapted for connection to respective inlet and outlet valves, a connecting rod (8) with at least two diaphragms thereon, and an eccentric drive (7) for driving the connecting rod, wherein a working diaphragm (16) closes the pump chamber (13) and has a deformable annular zone (24), said working diaphragm (16) being essentially generally flat and level in an undeformed condition, and at least one additional diaphragm (26) being arranged between the working diaphragm (16) and the eccentric drive (7) and having a deformable annular zone (30), whereby an at least essentially closed diaphragm interspace (29) is formed between the two diaphragms (16, 26) and is laterally defined by the pump case (2), and wherein the deformable annular zone (30) of the additional diaphragm (26) has a radial expanse wider than the deformable annular zone (24) of the working diaphragm (16), and the deformable annular zone (30) of the additional diaphragm (26) has a channel-like convexity (31) which in an undeformed condition of the diaphragm points toward the eccentric drive (7), wherein the additional diaphragm (26) has on a side thereof facing the eccentric drive 17) holding-down ribs (33), said holding-down ribs being connected to a connecting-rod arm (28) of the eccentric drive (7) by way of a hollow shank (34) incorporated in said diaphragm (26) and adapted to the connecting-rod arm (28), and said holding-down ribs being oriented toward a longitudinal axis of the connecting-rod arm (28).

2. A pump according to claim 1, wherein the channel-like convexity (31) is arranged so as to be at least approximately centered on a longitudinal central axis (M) of the connecting rod.

3. A pump according to claim 1, further comprising means for evacuating the diaphragm interspace (29).

4. A pump according to claim 1, wherein the channel-like convexity (31) of the additional diaphragm (26) has a holder (32) maintaining the convexity toward the eccentric drive (7).

5. A pump according to claim 1, wherein the diaphragm (26) has in an area of its channel-like convexity (31) which faces the eccentric drive (7) a stabilizing ring (37), up to which radially outer end areas of the holding-down ribs (33) may extend.

6. A pump according to claim 1, wherein the holding-down ribs (33) connect the hollow shank (34) of the diaphragm (26) to a bottom area of the channel-like convexity (31).

7. A pump according to claim 5, wherein the diaphragm (26) has on a side thereof facing the eccentric drive (7) stabilizing ribs (38) in an area between a side edge of said diaphragm and the stabilizing ring (37).

8. A pump according to claim 7, wherein the stabilizing ribs (38) are radially arranged with some of them being radially aligned with the holding-down ribs (33).

9. A pump according to claim 1, wherein a radially projecting retaining bead (36) is provided near an upper, free zone (25) of the connecting-rod arm (28), and an inner contour of the hollow shank (34) is adapted to an outer contour of the connecting-rod arm (28).

10. A pump according to claim 1, wherein the pump case (4) is provided with an evacuating passage (39) for the diaphragm interspace (29).

11. A pump according to claim 1, wherein the additional diaphragm (26) includes a holder (32), a stabilizing ring (37) and stabilizing ribs (38) located on the additional diaphragm, and the holder (32), the stabilizing ring (37) and the stabilizing ribs (38) are integrally formed with the additional diaphragm.

12. A pump according to claim 1, wherein the additional diaphragm (26) includes a holder (32), a stabilizing ring (37) and stabilizing ribs (38) located on the additional diaphragm, and the additional diaphragm is formed integrally with at least one of the holder (32), the stabilizing ring (37) and the stabilizing ribs (38).

* * * * *